United States Patent [19]

Yoshinaga et al.

[11] Patent Number: 4,793,314

[45] Date of Patent: Dec. 27, 1988

[54] FUEL INJECTION PUMP FOR AN INTERNAL COMBUSTION ENGINE

[75] Inventors: Toru Yoshinaga, Okazaki; Toshihiko Igashira, Toyokawa; Yasuyuki Sakakibara, Nishio; Seiko Abe, Okazaki; Yukihiro Natsuyama, Anjo, all of Japan

[73] Assignee: Nippon Soken, Inc., Nishio, Japan

[21] Appl. No.: 92,204

[22] Filed: Sep. 2, 1987

[30] Foreign Application Priority Data

Sep. 4, 1986 [JP] Japan ..... 61-208784

[51] Int. Cl.[4] ..... F02M 39/00

[52] U.S. Cl. ..... 123/506; 123/498; 123/500

[58] Field of Search ..... 123/506, 458, 500, 501, 123/498

[56] References Cited

U.S. PATENT DOCUMENTS 3,465,732 9/1969 Kattchee ..... 123/498
3,589,345 6/1971 Benson ..... 123/498
4,562,810 1/1986 Miyaki .
4,610,427 9/1986 Igashira et al. .
4,622,942 11/1986 Nozaki ..... 123/498
4,643,155 2/1987 O'Neill ..... 123/506
4,697,565 10/1987 Kobayashi ..... 123/506

*Primary Examiner*—Carl S. Miller
*Attorney, Agent, or Firm*—Cushman, Darby & Cushman

[57] ABSTRACT

A fuel injection pump including a valve opening and closing an overflow passage formed in a body of the pump to connect a high pressure chamber to a low pressure chamber. The low pressure chamber is provided for reserving low pressure fuel, and the high pressure chamber is provided for pressurizing fuel sent from the low pressure chamber and for discharging the pressurized fuel to fuel injectors. A plunger has intake grooves which open the feed passage to communicate the high pressure chamber with the low pressure chamber on an intake action of the pump. The body of the pump has a feed passage formed therein which connects the high pressure chamber to a control chamber. The pressure in the control chamber is changed by the expansion and contaction of a piezoelectric actuator, and the pressure in the control chamber urges the valve in a direction in which the valve closes the overflow passage. A start and end of a fuel injection period, and a fuel injection ratio (a pilot fuel injection), can be controlled by the opening and closing of the valve.

12 Claims, 7 Drawing Sheets

FUEL INJECTION PUMP FOR AN INTERNAL COMBUSTION ENGINE

BACKGROUND OF THE INVENTION

1. Field of the Invention

The present invention relates to a fuel injection pump for an internal combustion engine, more particularly, it relates to a fuel injection pump which supplies highly pressurized fuel under the control of a piezoelectric actuator.

2. Description of the Related Art

In a fuel injection pump of an internal combustion engine, especially a diesel engine, the fuel injection pump is preferably electronically controlled, to ensure that a precise fuel injection amount is obtained. In this connection, a pump in which an electromagnetic valve is provided for electronically controlling the fuel injection amount is well known. However, since diesel engines are now designed to be driven at high speeds, and because the number of cylinders provided has increased, a control device having a higher responsiveness than an electromagnetic valve is needed. Accordingly, a fuel injection pump provided with a piezoelectric actuator, which has a high responsiveness, has been proposed in a prior art. In such a fuel injection pump, a fuel injection period and amount are controlled by causing the piezoelectric actuator to expand and contract, thus varying a pressure in a control chamber. This variation in pressure causes a change in the position of a valve provided between a high pressure passage and a low pressure passage, and communication with between these passages is allowed or prevented according to the position of the valve.

Namely, the fuel injection pump is provided with a plunger slidably housed in a cylinder bore to define a high pressure chamber therein; the plunger moving backward to expand the high pressure chamber to cause fuel in a low pressure chamber to flow into the high pressure chamber, and then moving forward to compress fuel in the high pressure chamber and discharge the fuel outside of the fuel injection pump, and to cause undischarged surplus fuel to overflow from the high pressure chamber through an overflow passage.

However, in such a conventional fuel injection pump, the allowance and prevention of communication between the high and low pressure passages causes variations in the pressures acting on the valve, destabilizing the movement of the valve, and thus reducing the maximum fuel amount supplied.

SUMMARY OF THE INVENTION

Therefore, an object of the present invention is to provide a fuel injection pump by which a maximum fuel supply is fully realized.

According to the present invention, there is provided a fuel injection pump comprising a body, a valve means, a piezoelectric actuator, and an opening and closing means. The body has a feed passage connected to the low pressure chamber formed therein, and an overflow passage which is opened and closed by the valve means. The body is provided with a piezoelectric actuator, to define a control chamber therein, and the control chamber is communicated with the feed passage. The opening and closing means opens the feed passage to feed a pressure in the low pressure chamber to the control chamber, and then closes the feed passage to hold the pressure in the control chamber at a constant value. The piezoelectric actuator expands and contracts according to a voltage supplied thereto to vary a volume of the control chamber, and thereby open and close the valve means to control an amount of fuel supplied by the fuel supply device.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

The present invention will now be described below with reference to the attached drawings.

Figure 1:
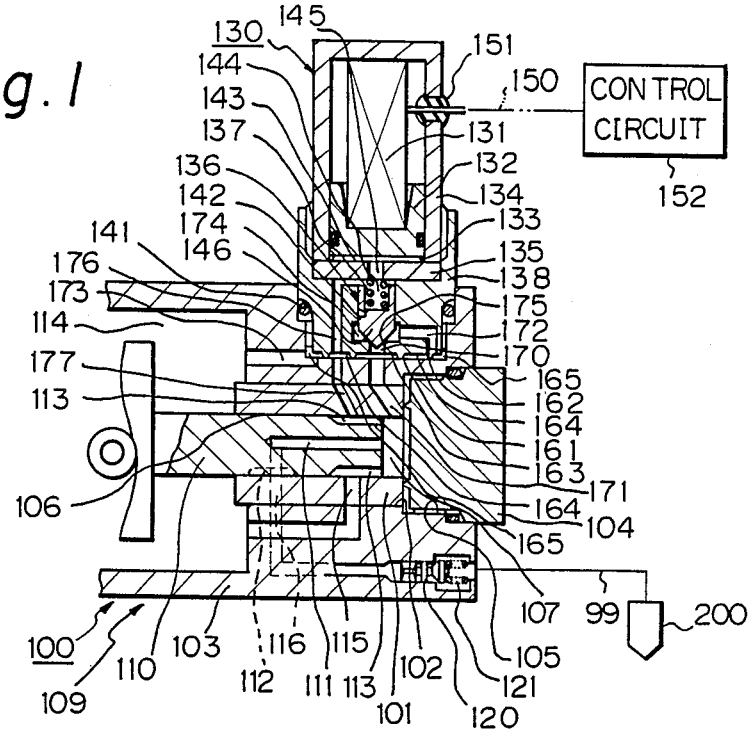
FIG. 1 is a sectional view of a first embodiment of the present invention.

In FIG. 1 a fuel injection pump 100 is a distributor type fuel injection pump and is connected to fuel injectors 200 which are provided at each cylinder of the diesel engine The fuel injection pump 100 pressurizes and sends fuel to the fuel injectors 200, which inject the pressurized fuel into the cylinders.

A cylinder member 101 is fitted in a bore 102 formed in a casing 103, and a plug 104 is fitted in an end bore 105 of the casing 103 to close one open end of the cylinder member 101. A body 109 is composed of the casing 103 and the cylinder member 101. A plunger 110 is slidably supported in a cylinder bore 106 of the cylinder member 101 to define a high pressure chamber 107 in the cylinder bore 106. As is well known, the plunger 110 is driven by the engine to rotate about and move forward and backward along its own axis in synchronization with a half rotation of the engine crankshaft, to compress and expand the high pressure chamber 107. A center hole 111 is formed in the center axial portion of the plunger 110, and a distribution port 112 and intake grooves 113 are formed on an outer surface of the plunger 110. The number of intake grooves 113 corresponds to the number of engine cylinders. A low pressure chamber 114 is formed in the casing 103 to reserve low pressure fuel and is communicated with the high pressure chamber 107 through one of the intake grooves 113 and an intake passage 115 formed in both the casing 103 and the cylinder member 101. The high pressure chamber 107 is communicated with one of the fuel injectors 200 through the center hole 111, the distribution port 112, and distribution passages 116 formed in both the cylinder member 101 and the casing 103, and a connecting line 99. The number of distribution passages 116 corresponds to the number of engine cylinders. A delivery valve 120 is provided in each distribution passage 116, and the delivery valve 120 is urged by a spring 121 to close the distribution passage 116, and urged to open the passage 116 against the spring 121 by a pressure therein. The delivery valve 120 acts as both a check valve and a suction return valve.

When the plunger 110 moves backward to expand the high pressure chamber 107, any one of the intake grooves 113 is communicated with the intake passage 115, so that fuel in the low pressure chamber 114 is caused to flow into the high pressure chamber 107 through the intake passage 115 and the intake groove 113. When the plunger 110 moves forward to compress the high pressure chamber 107, the distribution port 112 is communicated with one of the distribution passages 116, so that the pressurized fuel in the high pressure chamber 107 is discharged to the fuel injector 200 through the center hole 111, the distribution port 112, the distribution passage 116, and the connecting line 99. A needle valve (not shown) of the fuel injector 200 opens to inject fuel into a cylinder of the engine when the pressure of fuel supplied from the fuel injection pump 100 is higher than a predetermined value.

Note that the pump 100 is constructed in such a manner that the time at which the plunger 110 begins to move forward is earlier than the time at which the fuel injector 200 is commanded to begin a fuel injection, and the time at which the plunger 110 begins to move backward is later than the time at which the fuel injector 200 is commanded to stop the fuel injection.

The casing 103 and the cylinder member 101 are provided with an overflow passage comprised of passages 171, 170, 172, 165 and 173 as described later, which connects the low pressure chamber 114 to the high pressure chamber 107. The overflow passage is opened and closed by a pressure control valve mechanism 130. During a discharge of fuel by the fuel injection pump 100, the pressure control valve mechanism 130 opens or closes the overflow passage to cause undischarged surplus fuel to spill from the high pressure chamber 107 through the overflow passage, and thereby control a fuel injection starting time, a fuel injection amount, and a fuel injection rate of the fuel injection pump 100.

The pressure control valve mechanism 130 has a piezoelectric actuator 131, a piston 132, a belleville spring 133, a piezo-housing 134, a distance piece 135, a valve 136, a spring 137, and a valve housing 138. The piezo-housing 134 is threadingly fitted to the valve housing 138, which is threadingly fitted to the casing 103. The distance piece 135 is sandwiched between the piezo-housing 134 and the valve housing 138. An 0-ring 141 is provided between the casing 103 and the valve housing 138. The valve 136 is slidably housed in a bore 142 formed in the valve housing 138 to open and close the overflow passage under the control of the piezoelectric actuator 131. The valve 136 defines a spring chamber 144 in the bore 142. The piezoelectric actuator 131, the piston 132, and the belleville spring 133 are housed in the piezo-housing 134. The piston 132 is slidably supported in the piezo-housing 134 to define a control chamber 143 wherein the belleville spring 133 is housed to urge the piston 132 to the piezoelectric actuator 131. The control chamber 143 is communicated with the spring chamber 144 through an opening 145 formed in the distance piece 135. The spring 137 is disposed in the spring chamber 144 to urge the valve 142 in a direction in which the valve 142 closes the overflow passage.

The piezoelectric actuator 131 is a cylindrical laminate stack formed by piezoelectric (PZT) disks having a diameter of 15 mm and a thickness of 0.5 mm and copper disks having a diameter of 15 mm and a thickness of 0.1 mm, stacked alternately one on top of the other (not shown in the drawing). A lead wire 150 is connected to the copper disks so that a voltage can be applied to the PZT elements in parallel with the direction of thickness of each PZT element. The lead wire 150 is extended through a grommet 151 outside of the piezo-housing 134 and is connected to a control circuit 152, which causes the expansion and contraction of the piezoelectric actuator 131.

The PZT disks are made of a sintered ferroelectric ceramic containing zircon titanate as the base; this is a typical disk having a piezoelectric effect. The physical properties of this disk are such that, when a voltage of 500 V is applied in the direction of the thickness thereof, the thickness of the disk is increased by 0.5 $\mu$m, and when the voltage of 500 V is short-circuited, the thickness is reduced by 0.5 $\mu$m. Also, when a pressure of 200 kg/cm$^2$ is applied to the disk in the direction of the thickness thereof, a voltage of 200 V is developed in that direction.

In this embodiment, the piezoelectric actuator 131 has one hundred PZT elements electrically connected in parallel to each other, so that when a voltage of 500 V is applied thereto, the piezoelectric actuator 131 will be expanded by 50 $\mu$m.

Thus, the piezoelectric actuator 131 expands to move the piston 132 down against the spring 133 when a positive voltage is applied to the piezoelectric actuator 131, so that a pressure in the control chamber 143 is raised. Conversely, the piezoelectric actuator 131 contracts to allow the piston 132 to be moved up by the spring 133 when the positive voltage is released, so that the pressure in the control chamber 143 is reduced. The piezoelectric actuator 131 also contracts when a negative voltage is applied thereto.

The under surface of the valve housing 138 has a first annular projection 161 and a second projection 162 formed therein, which projections are formed coaxially and in a sealing contact with an outer surface of the casing 103, to define first, second, and third passages 163, 164, and 165 between the valve housing 138 and the casing 103. The first passage 163 is formed within the first annular projection 161 and is disk shaped; the second passage 164 is formed between the first and second annular projections 161 and 162 is annular shaped; and the third passage 165 is formed outside of the second annular projection 164 and is also annular shaped. These passages 163, 164, and 165 do not communicate with each other.

The first passage 163 is communicated with an opening 170 formed in the valve housing 138 and a high pressure passage 171 formed in both the casing 103 and the cylinder member 101. The high pressure passage 171 is communicated with the high pressure chamber 107. The third passage 165 is communicated with a passage 172 formed in the valve housing 138 and a low pressure passage 173 formed in the casing 103. The low pressure passage 173 is communicated with the low pressure chamber 114. The passage 172 and the opening 170 are connected to an enlarged chamber 174 in which a conical end portion 146 of the valve 136 is located. The end portion 146 is brought into contact with and separated from a seat 175 formed at the end of the opening 170, to open and close the opening 170. The overflow passage is formed by the high pressure passage 171, the first passage 163, the opening 170, the enlarged chamber 174, the passage 172, the third passage 165, and the low pressure passage 173. When the end portion 146 of the valve 136 is separated from the seat 175 to open the opening 170, the overflow passage is opened to connect the high pressure chamber 107 to the low pressure chamber 114. When the end portion 146 is brought into contact with the seat 175 to close the opening 170, the overflow passage is closed to shut off the high pressure chamber 107 from the low pressure chamber 114.

The second passage 164 is communicated with a passage 176 formed in the casing 103 and a communicating passage 177 formed in both the cylinder member 101 and the casing 103. The passage 176 is communicated with the spring chamber 144, that is, communicated with the control chamber 143 through the opening 145. The communicating passage 177 is communicated with the high pressure chamber 107 through the intake groove 113. A feed passage is formed by the communicating passage 177, the second passage 164, the passage 176, the spring chamber 144, and the opening 145. The high pressure chamber 107 is communicated with the control chamber 143 through this feed passage. When one intake groove 113 is communicated with the intake passage 115 and another intake groove 113 is communicated with the feed passage, the control chamber 143 is communicated with the low pressure chamber 114 through the feed passage, the high pressure chamber 107, and the intake passage 115, so that low pressure fuel in the low pressure chamber 114 is led to the control chamber 143. That is, the feed passage is connected to the low pressure chamber 114 through the high pressure chamber 107. A pressure in the control chamber 143 urges the valve 136 in a direction in which the valve 136 closes the opening 170, that is, the overflow passage.

The intake grooves 113 are communicated with the intake passage 115 and the communicating passage 177, or shut off from these passages 115 and 177, according to the rotational position of the plunger 110 about the axis thereof. The feed passage is open and closed by the rotation of the plunger 110. The communicating passage 177 is shut off from the high pressure chamber 107 by rotation of the plunger 110 before the plunger 110 begins to move forward to compress the high pressure chamber 107, and is communicated with the high pressure chamber 107 through the intake groove 113 by rotation of the plunger 110 after the plunger 11 begins to move backward to expand the high pressure chamber 107. That is, opening and closing of the feed passage is carried out by rotation of the plunger 110, and the control chamber 143 is communicated with the high pressure chamber 107 only when the plunger 110 moves backward to suck fuel in the low pressure chamber 114 into the high pressure chamber 107. The plunger 110 opens the feed passage to feed a pressure in the low pressure chamber 114 to the control chamber 143, and then closes the feed passage to hold the pressure in the control chamber 143 at a constant value.

The operation of the first embodiment is described with reference to FIGS. 2 through 4.

Figure 2:
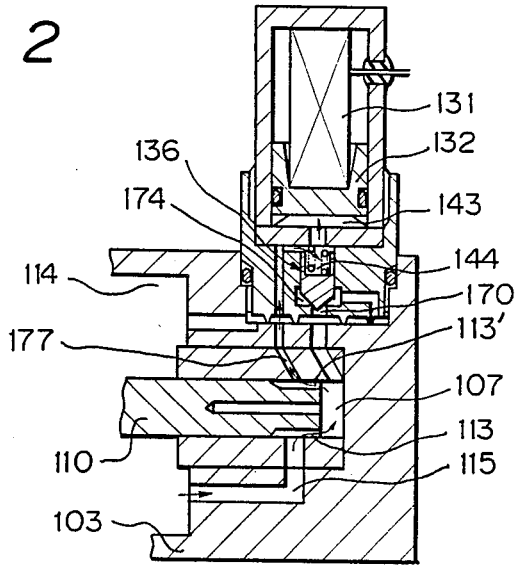
FIG. 2 is a sectional view of the first embodiment in a state in which the plunger moves backward.
Figure 5:
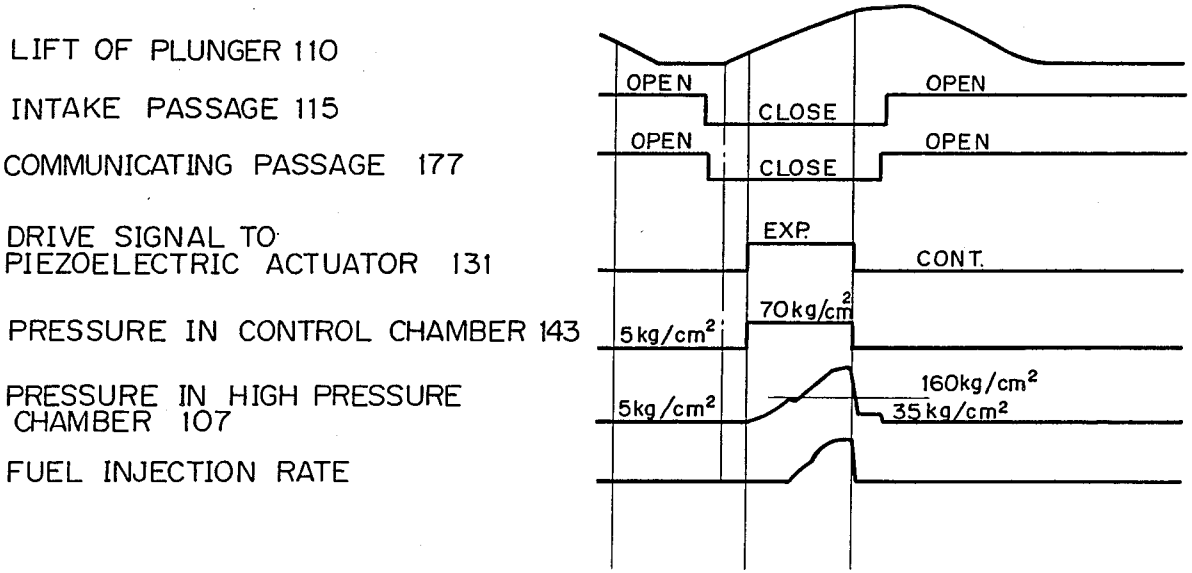
FIG. 5 is a time chart showing an action of the first embodiment.

FIG. 2 shows an intake process of the plunger 110, that is, a state in which the plunger 110 in moving backward. In this state, the piezoelectric actuator 331 is contracted. The intake groove 113 is communicated with the intake passage 115 to which fuel is fed from the low pressure chamber 114, to which fuel pressurized to 5 kg/cm$^2$ by a feed pump (not shown) is supplied. The fuel is drawn into the high pressure chamber 107 through the intake groove 113 when the plunger 110 moves backward. The intake groove 113', which is positioned at the opposite side 180° from the intake groove 113 communicating with the intake passage 115, is communicated with the communicating passage 177. Therefore, the pressure in the control chamber 143 and the spring chamber 144 is the same as that in the low pressure chamber 114, that is, 5 kg/cm$^2$, as shown in FIG. 5.

After the intake process of the plunger 110 is completed, the intake passage 115 is shut off from the high pressure chamber 107 by rotation of the plunger 110, and at the same time, the communicating passage 177 is shut off from the high pressure chamber 107.

Figure 3:
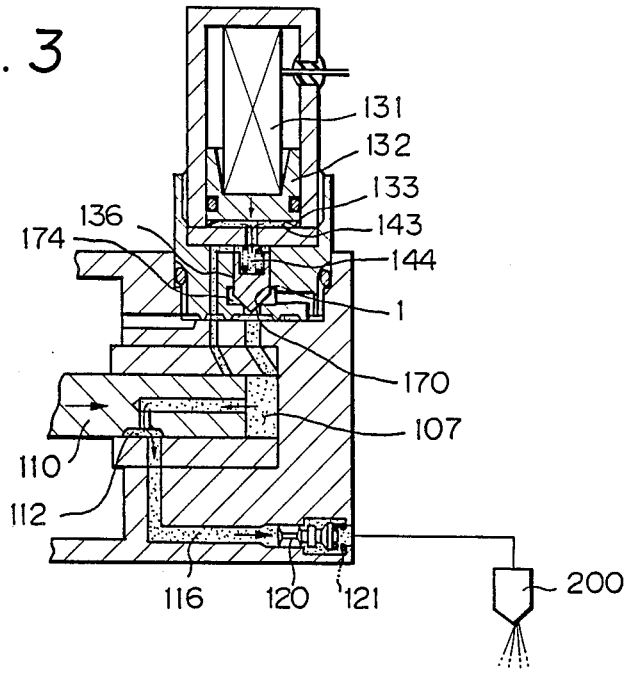
FIG. 3 is a sectional view of the first embodiment in a state in which the plunger moves forward to supply fuel.

A compression process, that is, a state in which the plunger 110 moves forward, is shown in FIG. 3. In this state, a fuel injection starting signal of 500 V is applied to the piezoelectric actuator 131 by the control circuit 152 (FIG. 1), so that the piezoelectric actuator 131 expands to move the piston 132 downward against the belleville spring 133, to reduce the volume of the control chamber 143. As a result, a pressure in the control chamber 143 is raised to 70 kg/c$^2$, as shown in FIG. 5, so that the valve 136 is pressed against the seat 175 to close the opening 170 and shut off the high pressure chamber 107 from the enlarged portion 174. The forward movement of the plunger 110 raises the pressure in the high pressure chamber 107. The needle valve of the fuel injector 200 is constructed to open at 160 kg/cm$^2$ pressure, and therefore, when the pressure in the high pressure chamber 107 reaches the valve opening pressure (160 kg/cm$^2$), the fuel injector 200 starts to inject fuel. The plunger 110 then continues to move forward, so that the pressure in the high pressure chamber 107 is further raised.

The diameter of the valve 136 is 6 mm, and the pressure in the control chamber 143 is 70 kg/cm$^2$. Therefore, a valve closing force $F_1$ urging the valve 136 in a direction in which the valve 136 closes the opening 170 is obtained by the following equation:

$$F_1 = 70 \times \frac{\pi}{4} \times (0.6)^2 = 19.8 \text{ kgf}$$

The diameter of the opening 170 is 2.3 mm. Therefore, if the pressure in the high pressure chamber 107 for opening the valve 136 is $P_1$, $$P_1 \times \frac{\pi}{4} \times (0.23)^2 = F_1$$

Therefore, $$P_1 = 480 \text{ kg/cm}^2$$

However, since the maximum pressure generated by the fuel injection pump 100 in this embodiment is 450 kg/cm² at a high engine speed, the valve 136 will remain closed for a fuel injection process.

Figure 4:
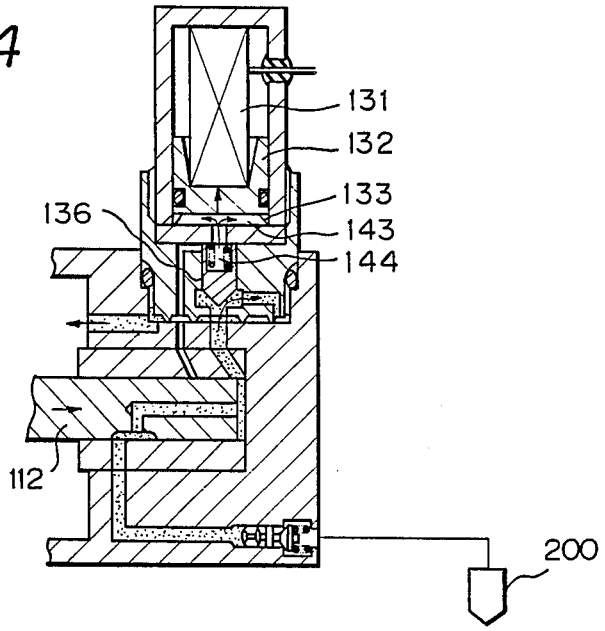
FIG. 4 is a sectional view of the first embodiment in a state in which the valve opens the overflow passage to end a fuel supply.

At the end of the fuel discharge process by the plunger 110, the control circuit 152 releases the 500 V applied to the piezoelectric actuator 131, so that the piezoelectric actuator 131 contracts as shown in FIG. 4, and thus the piston 132 is moved upward by the spring 133. This causes an increase in the volume of the control chamber 143, so that the pressure in the control chamber 143 is reduced to 5 kg/cm² from 70 kg/cm² as shown in FIG. 5. In this state, the valve closing force $F_2$ urging the valve 136 downward is obtained by the following equation:

$$F_2 = 5 \times \frac{\pi}{4} \times (0.6)^2 = 1.4 \text{ kgf}$$

The pressure $P_2$ in the high pressure chamber 107 is equivalent to the force $F_2$, as follows:

$$P_2 = 35 \text{ kg/cm}^2$$

Therefore, the valve 136 will remain open until the pressure in the high pressure chamber 107 falls below 35 kg/cm², so that the pressurized fuel in the high pressure chamber 107 is spilled to the low pressure chamber 114, as shown in FIG. 5. Then, if the intake groove 113 is communicated with the intake passage 115, the pressure in the high pressure chamber 107 is reduced to the same pressure as in the low pressure chamber 114, that is, 5 kg/cm².

As described above, according to the first embodiment, the fuel injection starting time is controlled by adjusting the time of the expansion of the piezoelectric actuator 131, and the fuel injection ending time (fuel injection amount) is controlled by adjusting the time of the contraction of the piezoelectric actuator 131. Further, since low pressure fuel in the low pressure chamber 114 is fed to the control chamber 143 through the high pressure chamber 107 by the intake process of the plunger 110 (FIG. 2), the valve 136 is always subjected to a stable fuel pressure in the low pressure chamber 114 so that the pressure acting on the valve 136 does not fluctuate. Therefore, the opening 170 will not be inadvertently opened or closed by undesired movement of the valve 136, so that the maximum fuel injection rate and the normal fuel injection rate is not reduced.

Figure 6:
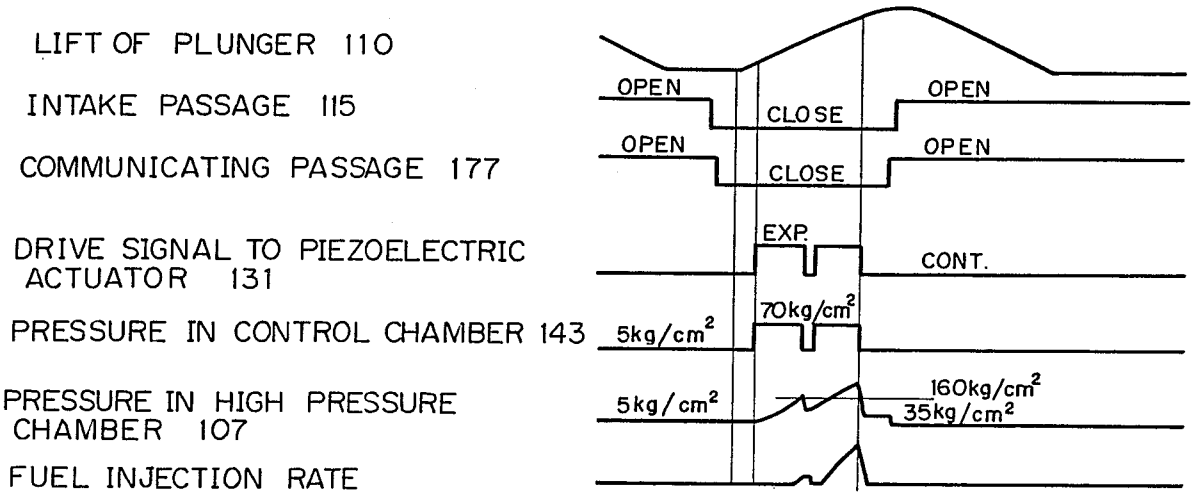
FIG. 6 is a time chart showing an action in which a pilot injection is carried out in the first embodiment.

A pilot injection, that is, a fuel injection rate control, can be also carried out by the construction of the first embodiment. FIG. 6 shows the movement of each portion with the elapse of time in the fuel injection rate control. In FIG. 6, different from FIG. 5, the piezoelectric actuator 131 expands, contracts once, then expands again. Therefore, a pressure in the control chamber 143 is lowered when the piezoelectric actuator 131 contracts once, so that the valve 136 opens momentarily, and then again closes, the opening 170. This action lowers a pressure in the high pressure chamber 107 to cause a momentary pause in a fuel injection, as shown in FIG. 5, so that a pilot fuel injection is carried out.

As described above, a fuel injection amount for a pilot injection and a main injection, and an interval for the pilot injection and main injection, are controlled by changing the timing of the contraction and expansion of the piezoelectric actuator 131.

Figure 7:
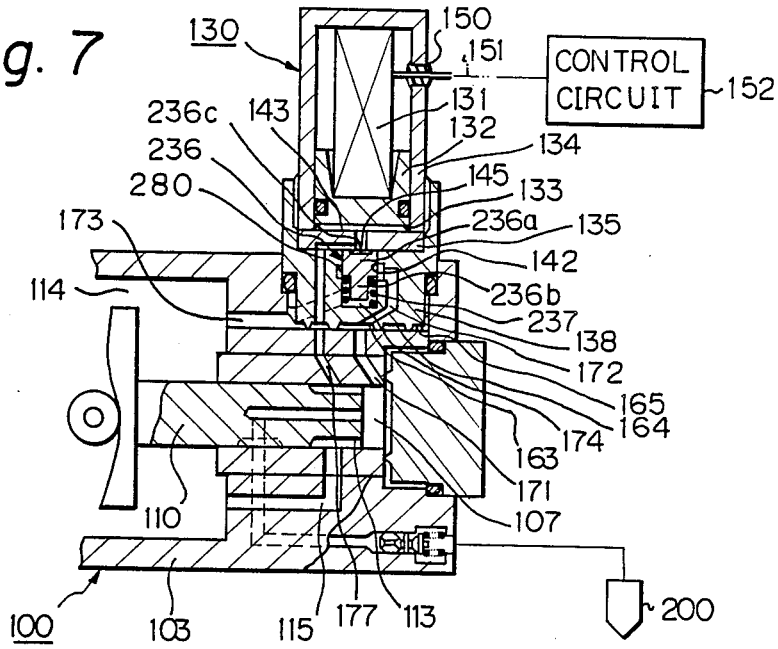
FIG. 7 is a sectional view of a second embodiment of the present invention.

FIG. 7 shows a second embodiment of the present invention. In this second embodiment, the valve 236 is a spool valve as shown in FIG. 7, which is a basic difference between this embodiment and the first embodiment.

In FIG. 7, the spool type valve 236 has a large diameter portion **236*a* and a small diameter portion 236*b*, that is, as a step-shaped cylinder, and is slidably supported in the bore 142 formed in the valve housing 135. An upper surface of the valve 236 is provided with a recess 236*c* having a diameter larger than the diameter of the passage 145, so that a relatively large area of the valve 236 is subjected to a pressure in the control chamber 143. A spring 237 is provided between the small diameter portion 236*b* and the valve housing 138 to urge the valve 236 upward and in contact with the distance piece 135. If the pressure in the control chamber 143 is raised, the valve 236 is moved downward against the spring 237, so that a lower surface of the small diameter portion 236*b* is in contact with the valve housing 138**.

The enlarged chamber 174 formed between the passages 172 and 173 has an annular groove 280 formed on the bore 142. This annular groove 280 is communicated with the passage 172, that is, the high pressure passage 171 and the high pressure chamber 107. The outer portion of the enlarged chamber 174 is communicated with the low pressure chamber 114 through the passage 173. The valve 236 is slidably housed in the enlarged chamber 174, and outer surface of the valve 236 opens and closes the annular groove 280.

The spring 237 urges the valve 236 in a direction in which the valve 236 opens the annular groove 280. Therefore, when a pressure in the control chamber 143 is relatively low, the annular groove 280 is opened by the valve 236, so that the passages 172 and 173 are communicated with each other. Conversely, when a pressure in the control chamber 143 is raised to move the valve 236 downward against the spring 237, the annular groove 280 is closed by the large diameter portion **236*a* of the valve 236, so that the passages 172 and 173** are shut off from each other.

The operation of the second embodiment is as follows.

In an intake process of the plunger 110, the intake groove 113 of the plugger 110 is communicated with the intake passage 115, and the other intake groove 113' positioned on the opposite side of the intake groove 113 is communicated with the communicating passage 177. Therefore, a pressure in the control chamber 143 is the same as that in the high pressure chamber 107 and the low pressure chamber 114. When the intake process of the plunger 110 is completed, the intake passage 115 and the communicating passage 177 are shut off from each other by rotation of the plunger 100.

In a compression process of the plunger 110, a fuel starting signal 500 V is applied to the piezoelectric actuator 131 by the control circuit 152, so that the piezoelectric actuator 131 expands to move the piston 132 downward against the spring 133 to reduce the volume of the control chamber 143. Accordingly, a pressure in the control chamber 143 is raised so that the valve 236 is moved downward so that the large diameter portion **236*a* closes the annular groove 280. Therefore, a fuel pressure in the high pressure chamber 107 is increased as the plunger 110 moves forward to compress the high pressure chamber 107, so that fuel is injected from the fuel injector 200**.

When the plunger 110 finishes the fuel discharge, the voltage applied to the piezoelectric actuator 131 is released, so that the piezoelectric actuator 131 contracts, and thus the piston 132 is moved upward by the spring 133. Therefore, the volume of the control chamber 143 is increased, so that the valve 236 is moved upward and returned to the original position thereof. As a result, the annular groove 280 is opened, so that pressurized fuel in the high pressure chamber 107 is spilled to the low pressure chamber 114 through the high pressure passage 171, the passage 172, the annular groove 280, the enlarged chamber 164, and the passage 173. That is, the fuel discharge operation of the fuel injection pump 100 is completed.

The operation and effect of the second embodiment are basically the same as the first embodiment.

Figure 8:
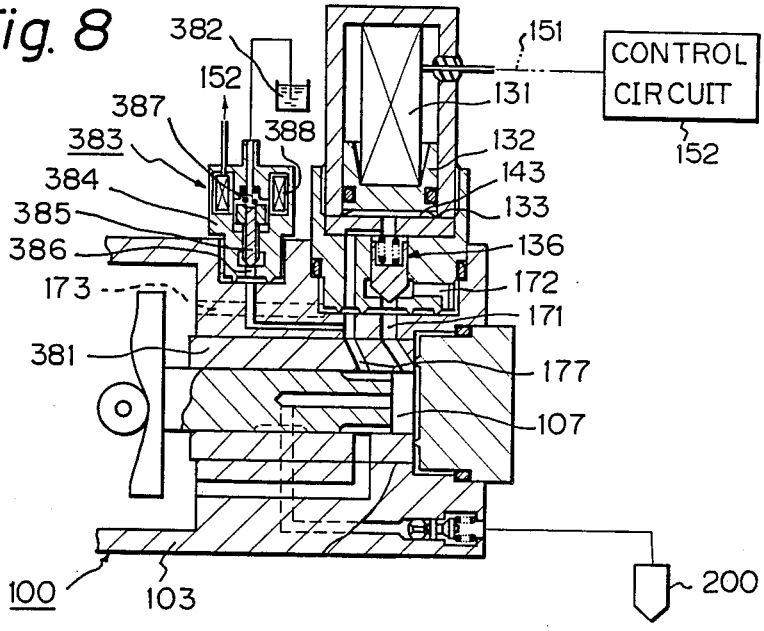
FIG. 8 is a sectional view of a third embodiment of the present invention.

FIG. 8 shows a third embodiment of the present invention.

In the first embodiment shown in FIG. 1, if foreign matter becomes stuck between the conical end portion 146 of the valve 136 and the seat 175, the valve 136 can not come into a sealing contact with the seat 175, since a clearance is formed between the end portion 146 and the seat 175, so that fuel in the high pressure chamber 107 is always spilled to the low pressure chamber 114 through the overflow passage. Therefore, when a fuel injection process is finished, even if the piezoelectric actuator 131 contracts, the valve 136 does not move upward since the fuel pressure in the high pressure chamber 107 is low. Accordingly, the foreign matter remains between the valve 136 and the seat 175, and since a pressure in the high pressure chamber 107 is not raised sufficiently, the fuel injector 200 cannot inject fuel.

For preventing this sticking of foreign matter, in the third embodiment, the communicating passage 177 connecting the high pressure chamber 107 and the control chamber 143 is communicated with a release passage 381 which is connected to a reservoir 382 reserving fuel at atmospheric pressure, and an electromagnetic valve 383 is provided for opening and closing the release passage 381.

A valve housing 384 of the electromagnetic valve 383 is threadingly fitted to the casing 103, and a valve needle 385 is housed in a chamber formed in the valve housing 384 to open and close an opening 386 provided in the valve housing 384 and communicated with the release passage 381. A spring 387 is located in the chamber t urge the valve needle 385 to close the opening 386. A solenoid coil 388 is provided in the valve housing 384, and the control circuit 152 applies a voltage thereto to displace the valve needle 385 upward against the spring 38 and open the opening 386. The valve needle 385 is formed with groove passages 389 on an outer surface thereof, so that fuel in the release passage 381 flows to the reservoir 382 through the opening 386 and the groove passages 389 when the valve needle 385 is open. Thus, fuel in the control chamber 143 is spilled to the reservoir 382 through the electromagnetic valve 383, so that a pressure in the control chamber 143 is lowered to the atmospheric pressure. When the pressure in the control chamber 143 is at atmospheric pressure, the valve 136 is moved upward by a relatively high pressure in the low pressure chamber 114 and is moved downward by the atmospheric pressure in the release passage 381, so that the valve 136 achieves the maximum lift when opening the opening 170. Accordingly, any foreign matter stuck between the valve 136 and the seat 175 is removed from the seat 175 and flows to the low pressure chamber 114 through the release passage 381. Then the voltage applied to the solenoid coil 388 is released so that the valve needle 385 is moved downward by the spring 387 to close the opening 386, and thus a fuel discharge by the fuel injection pump 100 becomes possible.

Note, control of the electromagnetic valve 383 may be carried out for a period in which the engine continues to rotate for several cycles due to inertia after the engine key switch is turned OFF, so that foreign matter stuck between the valve 136 and the seat 175 is removed.

In another method of control of the valve 383, a pressure sensor (not shown) is provided in the high pressure chamber 107 to sense the pressure in the high pressure chamber 107 while the engine is driven, so that a voltage is applied to the solenoid coil 388 for several cycles of rotation of the engine after the pressure sensor senses that the pressure in the high pressure chamber 107 is not higher than a predetermined value. In a further method of control, a sensor detecting a change of revolutional speed of the fuel injection pump 100 is provided instead of the pressure sensor, so that the sensing of the presence of foreign matter is based on the change in revolutions, and then a voltage is applied to the solenoid coil 388.

Figure 9:
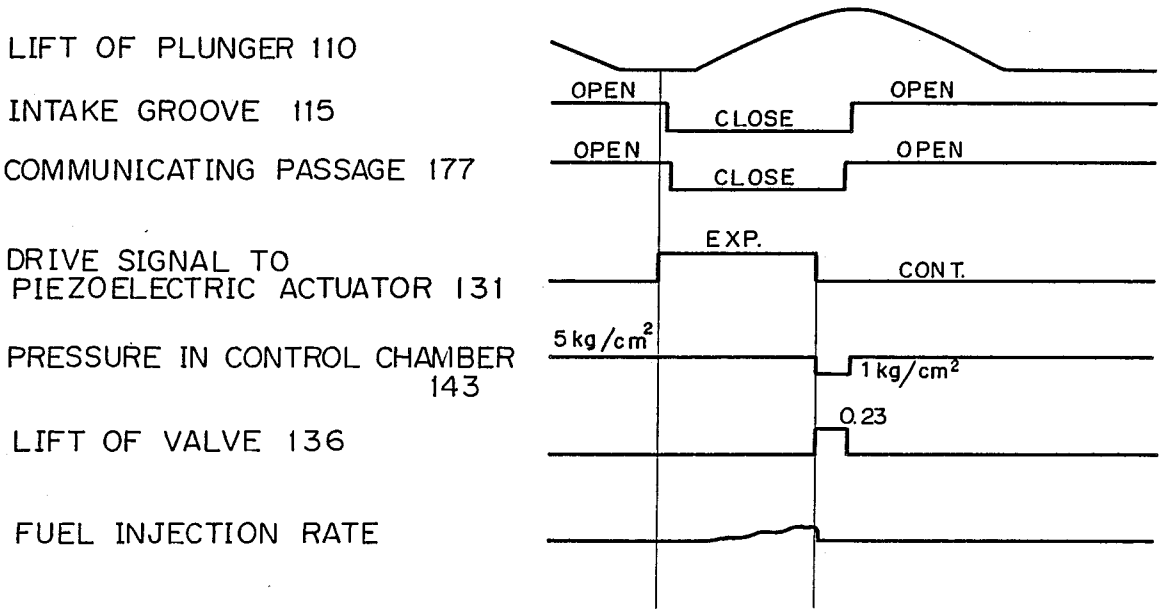
FIG. 9 is a time chart showing an action by which foreign matter in the overflow passage is removed therefrom.

Note, the construction of the first embodiment can carry out a control by which foreign matter stuck between the valve 136 and the seat 175 is removed, as shown in FIG. 9. That is, when the presence of foreign matter is sensed, the control shown in FIG. 5 is changed to the control shown in FIG. 9 for several cycles of engine revolution.

The difference between the controls shown in FIGS. 9 and 5 lies in the timing of the expansion of the piezoelectric actuator 131. That is, in the control shown in FIG. 5, the piezoelectric actuator 131 is expanded after the communicating passage 177 is closed by the plunger 110, but in the control shown in FIG. 9, the piezoelectric actuator 131 is first expanded and then the communicating passage 177 is closed by the plunger 110. Therefore, when the piezoelectric actuator 131 is kept in an expanded state, the pressure in the control chamber 143 is held at 5 $kg/cm^2$.

Then, when the piezoelectric actuator 131 is contracted, the volume of the control chamber 143 is reduced, so that the pressure in the control chamber 143 is lowered to 1 $kg/cm^2$. At this time, the upper surface of the valve 136 is subjected to the low pressure in the control chamber 143, while the lower surface of the valve 136 is subjected to a pressure which is higher than the pressure in the low pressure chamber 114. Therefore, the valve 136 is moved upward to open the opening 170 to the maximum degree of opening (0.23 mm), so that any foreign matter therein is removed from the valve 136. This control is carried out for several engine revolutional cycles, and is then changed to the control shown in FIG. 5. If the foreign matter has been removed, the control shown in FIG. 5 is continued, but if the foreign matter has not been removed, the control shown in FIG. 9 is again carried out for several engine revolutional cycles.

In another method of control for removing foreign matter, the control method shown in FIG. 10 may be carried out to ensure a lift of the valve 136 as described below.

Figure 10:
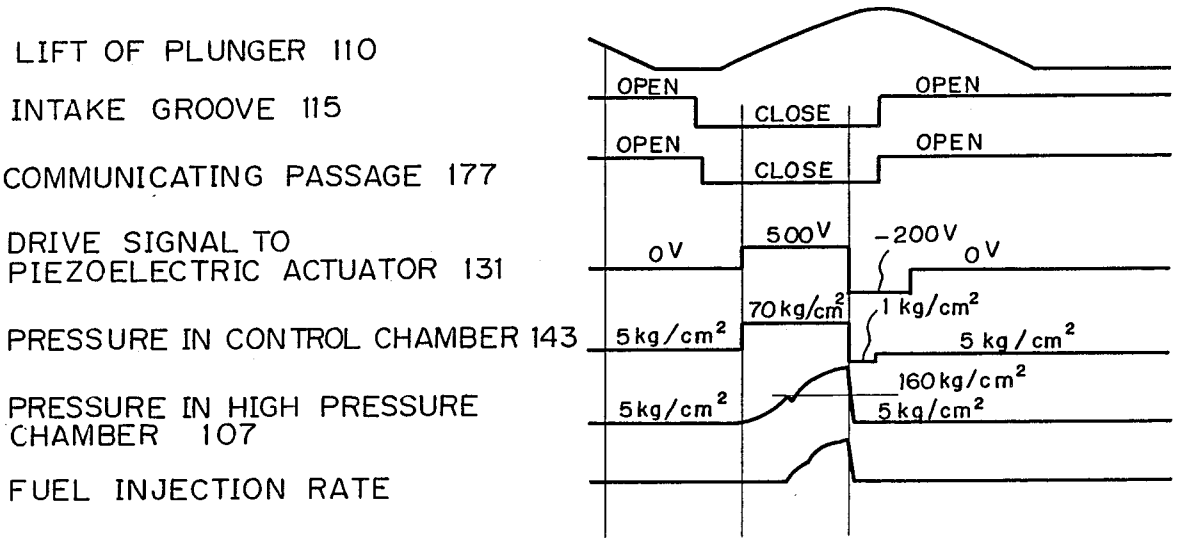
FIG. 10 is a time chart showing another action by which foreign matter in the overflow passage is removed therefrom.

The control method shown in FIG. 10 is different from the control shown in FIG. 5 in the following point. That is, upon completion of a fuel injection, a negative voltage (−200 V) is applied to the piezoelectric actuator 131 to cause it to contract to a length which is shorter than the normal length. Therefore, a pressure in the control chamber 107 is lowered below a pressure in the low pressure chamber 114, so that proper lift of the valve 136 is ensured to prevent foreign matter from sticking between the valve 136 and the seat 175. Even if foreign matter is stuck between the valve 136 and the seat 175, since a pressure in the control chamber 143 is lowered below 1 kg/cm$^2$ at every cycle, the valve 136 is always opened to the maximum lift, so that the foreign matter is removed.

Note, in a fuel injection control (a pilot injection), the voltage applied to the piezoelectric actuator 131 is changed as follows: 0 V→500 V→−200 V →500 V→−200 V→0 V, and this control is repeated. To simplify the control, the voltage applied may be changed as follows, 0 V→500 V→0 V→−200 V→0 V only in the pilot injection. This is because, at the end of the fuel injection, a pressure in the high pressure chamber 107 must be lower than a pressure which will cause the needle valve of the fuel injector 200 to open, and thus it is not necessary for the valve 136 to open the opening 170 to the maximum degree of opening.

Although embodiments of the present invention have been described herein with reference to the attached drawings, many modifications and changes may be made by those skilled in this art without departing from the scope of the invention.

We claim:

1. A fuel injection pump for an internal combustion engine comprising:

a body having a cylinder bore, low pressure chamber, an overflow passage coupled to said cylinder bore and communicating with said low pressure chamber, and a feed passage formed in said cylinder bore and open to said cylinder bore;

a plunger slidably housed in said cylinder bore to define a high pressure chamber therein, said plunger configured to draw low pressure fuel from said low pressure chamber into said high pressure chamber when it moves backward and to compress fuel in said high pressure chamber to discharge the fuel to outside of said pump when it moves forward;

valve means for opening and closing said overflow passage to said cylinder bore according to a fuel pressure acting thereon, said valve means opening to cause undischarged surplus fuel to spill from said high pressure chamber through said overflow passage;

a piezoelectric actuator attached to said body to define a control chamber therein, said control chamber communicating with said feed passage, a fuel pressure in said control chamber urging said valve means in a direction in which said valve means closes said overflow passage, said piezoelectric actuator expanding and contracting according to a voltage applied thereto to vary the fuel pressure in said control chamber and thereby open and close said valve means to control a fuel supply; and means for opening and closing said feed passage, said opening and closing means opening said feed passage to feed the low pressure fuel in said low pressure chamber to said control chamber through said overflow passage, said high pressure chamber and said feed passage on an intake action of said plunger, and then closing said feed passage to hold the pressure in said control chamber at a desired value.

2. A fuel injection pump according to claim 1, wherein said valve means has an end portion which opens and closes said overflow passage.

3. A fuel injection pump according to claim 2, wherein said overflow passage has an enlarged portion in which said end portion is located, said enlarged portion having a seat which is located in an upstream portion of said overflow passage, said end portion being brought into contact with and separated from said seat respectively to open and close said overflow passage.

4. A fuel injection pump according to claim 1, wherein said valve means has an outer surface which opens and closes said overflow passage.

5. A fuel injection pump according to claim 4, wherein said overflow passage has an enlarged portion in which said valve means is located, said enlarged portion having an annular groove which is located in said overflow passage, said outer surface opening and closing said annular groove.

6. A fuel injection pump according to claim 1, wherein said valve means has a spring urging said valve means in a direction in which said valve means closes said overflow passage.

7. A fuel injection pump according to claim 1, wherein said valve means has a spring urging said valve means in a direction in which said valve means opens said overflow passage.

8. A fuel injection pump for an internal combustion engine comprising:

a body having a cylinder bore, a low pressure chamber, an overflow passage, and a feed passage formed therein;

a plunger slidably housed in said cylinder bore to define a high pressure chamber therein, said plunger moving backward to draw low pressure fuel in said low pressure chamber into said high pressure chamber, and then moving forward to compress fuel in said high pressure chamber to discharge the fuel outside of said pump;

a valve means for opening and closing said overflow passage according to a fuel pressure acting thereon, said valve means opening to cause undischarged surplus fuel to spill from said high pressure chamber through said overflow passage;

a piezoelectric actuator attached to said body to define a control chamber therein, said control chamber communication with said feed passage, a fuel pressure in said control chamber urging said valve means in a direction in which said valve means closes said overflow passage, said piezoelectric actuator expanding and contracting according to a voltage applied thereto to vary the fuel pressure in said control chamber and thereby open and close said valve means to control a fuel supply and means for opening and closing said feed passage, said opening and closing means opening said feed passage to feed the low pressure fuel in said low pressure chamber to said control chamber on an intake action of said plunger, and then closing said feed passage to hold the pressure in said control chamber, wherein said valve means has a recess which is subjected to a pressure in said control chamber.

9. A fuel injection pump according to claim 1, wherein said piezoelectric actuator expands to raise the pressure in said control chamber when a positive voltage is applied to said piezoelectric actuator, and contracts to reduce the pressure in said control chamber when said positive voltage is released or a negative voltage is applied to said piezoelectric actuator.

10. A fuel injection pump according to claim 1, wherein said feed passage is connected to said low pressure chamber through said high pressure chamber.

11. A fuel injection pump according to claim 10, wherein said opening and closing means has at least one intake groove on an outer surface of said plunger, said plunger rotating about its own axis so that said feed passage is opened to communicate with said high pressure chamber through said intake groove and is closed to be shut off from said high pressure chamber.

12. A fuel injection pump according to claim 1, further comprising means for releasing a pressure in said control chamber, said releasing means having a reservoir reserving fuel at an atmospheric pressure, a release passage connecting said control chamber to said reservoir, and a relief valve opening and closing said release passage.

* * * * *